United States Patent [19]

Bäuerle

[11] Patent Number: 5,033,887

[45] Date of Patent: Jul. 23, 1991

[54] PROCESS FOR THE PRODUCTION OF INFORMATION RELATIVE TO THE TYPE OF A PRINTING HEAD

[75] Inventor: Ralph Bäuerle, Berlin, Fed. Rep. of Germany

[73] Assignee: Nixdorf Computer AG, Paderborn, Fed. Rep. of Germany

[21] Appl. No.: 381,222

[22] Filed: Jul. 14, 1989

[30] Foreign Application Priority Data

Jul. 25, 1988 [DE] Fed. Rep. of Germany ..... 3825231
Jul. 25, 1988 [DE] Fed. Rep. of Germany ..... 3825232

[51] Int. Cl.[5] ..... B41J 2/00
[52] U.S. Cl. ..... 400/175; 400/692
[58] Field of Search ..... 400/120, 148, 149, 175, 400/692; 324/649

[56] References Cited

U.S. PATENT DOCUMENTS 4,419,623 12/1983 Ketchledge ..... 324/649
4,462,704 7/1984 Kurata ..... 400/120
4,473,796 9/1984 Nankivil ..... 324/649
4,595,935 6/1986 Brooks ..... 400/120
4,735,517 4/1988 Knox ..... 400/157.2
4,741,634 5/1988 Nozaki ..... 400/120
4,778,291 10/1988 Mitsuhashi ..... 400/175
4,824,267 4/1989 Nakajima ..... 400/149
4,930,915 6/1990 Kikuchi ..... 400/692

*Primary Examiner*—David A. Wiecking
*Assistant Examiner*—Steven S. Kelley
*Attorney, Agent, or Firm*—Dykema Gossett

[57] ABSTRACT

Described is a process for producing information relative to the type of a printer head (18) present in a printer, which head contains at least one printer element (86, 88, 90). The servo component of the printing element (86, 88, 90) has an electrical resistance, which is determined via an electrical evaulation circuit. This resistance is assigned to one of several resistance ranges representing various types of printing head. Depending upon this completed assignment, the evaluation circuit produces a type signal (40*a*, 40*b*, 40*c*) as information. The type signal (40*a*, 40*b*, 40*c*) is made available to a subsequent control, whic can then supply the various types of printing heads (17, 18) with specifically suitable control signals. The invention can be used with practically all types of printing heads, whose printing elements are actuated by electrical or electromechanical servo components and therefore have an electrical resistance.

20 Claims, 4 Drawing Sheets

PROCESS FOR THE PRODUCTION OF INFORMATION RELATIVE TO THE TYPE OF A PRINTING HEAD

TECHNICAL FIELD

This invention pertains to a method and apparatus for the production of information, which specifies the type of a printing head in a printer containing at least one printing head, the servo component of which has an electrical resistance.

BACKGROUND ART

In electronic data processing layouts, printers are used for the output of texts, data, and graphic information. The transfer of printed symbols onto a carrier, e.g., paper, is accomplished by a printing head. Never printers are characterized by the fact that they can contain printing heads of various types in a single printer housing. Such a printer is described, e.g., in German Patent (OLS) No. 3,511,386. In this device, the printing heads in a printing station can be interchanged, while a printer can contain several such printing stations. This printer has a simple basic housing, which can be very economically produced in great unit quantity. Depending upon its anticipated use, the basic housing unit can be equipped with various printing heads, while the decision on specific equipment options can be delayed until final assembly. In this way, it is possible to achieve a great variety of types of printers and a high level of fabrication economy. Devices of this type are used, e.g., as passbook printers, cash voucher printers, etc.

There is a whole series of printing processes, which have led to differing functional principles and designs of printing heads. For transferring the printed symbols onto the carrier, the printing heads have a multitude of printing elements, which are variably designed in keeping with the different printing processes. Among these, the mosaic printing process has attained special significance. In this process, the symbol pattern is made up of colored dots assembled together in the manner of a mosaic by the printing elements. In each instance, these printing elements are actuated by a servo component, the electrical resistance of which can be, in addition to an active resistance, also a reactance or an impedance with a capacitive or an inductive component. In an ink-mosaic printing process, such a printing element consists of a jet, which, when a piezoelectrical servo component is actuated by an electrical impulse, sprays a droplet of ink onto the data carrier to form a colored dot. The printed symbol is formed by the combining of many such individual colored dots in a grid. In another process, which may be referred to as pin printing, the individual printing elements are designed as pins. By means of an electromechanical servo component responding to the dynamic effect of a current passing through a coil, pins are directed outward to press an inked ribbon against the print carrier, whereby a dotted symbol pattern is also formed. Finally, there is also the thermal printing process, in which the printing element contains an ohmic resistor as its servo component, which heats up when a current is introduced. By means of a liquescent color ribbon, dotted print symbols are transferred to the print carrier or formed directly on a heat-sensitive recording carrier.

For carrying out the printing operation, the printing head must be provided with control signals, which have a definitive value range and represent control parameters. These control parameters are produced in a control unit, to which the information to be printed is provided. Important control parameters are, e.g., the selection of the printing element for printing a mosaic dot or a combination of printing elements for printing a symbol, as well as the amount of energy, which must be provided to the respective printing elements for executing the printing action. Another important control parameter determines the timing and the duration of the printing action. By virtue of the time-sequencing control of the printing action, the location of the printed symbol on the carrier is determined independently of the relative displacement between the printing head and the carrier. Various types of printing heads differ in their control parameters. When different types of printing heads are to be installed in one printer, the control parameters to be readied by the control unit must also be matched to the type of the printing head. Inasmuch as the control parameters for the various types of printing heads are known, it is possible to construct a control unit in such a way that it contains all of the control parameters for the various types of printing heads planned for a printer and to call them up as needed. The control parameters can, e.g., be stored as data in a memory or preestablished as switchable circuits. In order that the control unit can ready the control parameters to be furnished to a printing head, it requires information relative to the type of the printing head to be addressed.

This can be accomplished in such a way that a trained operator determines in a manual check the type or kind of the printing head and provides this information to the control unit by actuating a coding switch of the control unit. This procedure includes the inherent danger of erroneous operation as a result of improper identification of the printing head or incorrect switch setting. Furthermore, mechanical structures necessary to preclude inadvertent or unauthorized access to the coding switch. Consequently, it would be desirable for the transmission of information relative to the type of the printing head to be automatically elucidated by the printer in the interest of preventing, with a very high degree of probability, erroneous operation of the printer.

SUMMARY OF THE INVENTION

The objective of the invention is to provide a method and apparatus which automatically determines the type of the printing head installed in a printer and provides this information to subsequent controls.

For a process of the general type cited in the introduction, this objective is realized, in keeping with the invention, in that the resistance is determined and relayed to one of several resistance ranges corresponding to different types of printing heads, and that a type signal dependent upon the established relay is produced as information.

The electrical resistance of a printing element is utilized as the distinguishing characteristic among the various types of printing heads. This resistance is characteristic for a specific type of printing head. E.g., a printing element of an ink-spray printing head with piezoelectric servo component has a high active resistance with a capacitive impedance component, while the printing element of a pin printing head containing a coil has a low resistance value with an inductive component. The resistance value of the printing elements of a thermal printing head usually lies somewhere between these values. The resistance value of printing heads within a given class, e.g., the class of pin printing heads, can also characterize a certain design or type of a printing head. For example, the coils for actuating the printing elements of pin printing heads with a long pin stroke and those for pin printing heads with a short pin stroke are of different design, i.e., the resistance values of these coils can be evaluated as distinguishing characteristics.

The resistance of the printing elements of various types of printing heads either is already known in advance or can be readily determined by simple resistance measurement. The resistance value of the printing elements of a certain type of printing head lies within a narrow tolerance span of a defined resistance range. The invention takes advantage of this information, in that the resistance value of a printing element of a printing head to be checked is determined and assigned to one of the preestablished resistance ranges. The established order is confirmed by a type signal. The resistance value of a printing element can then be determined in a simple manner via the same circuit carrying the electrical energy for actuating the printing element. In such a case, no further structure such as additional contacts or signal circuits, are required on the printing head, but instead ordinary commercial printing heads can be used. The result is a significant economical advantage. The invention can be used with practically all types of printing heads, whose printing elements are actuated via electrical or electromechanical servo components and therefore have an electrical resistance.

In determining the resistance, the resistance value of $\infty$ also has practical significance as recognition information. This value is to be interpreted as indicating that a certain printing element, whose resistance value is to be determined, is not present in the printing head. The presence or absence of a printing element can characterize a certain type of a printing head. For example, in this manner it is possible to distinguish between a 7-pin printing head and a 9-pin printing head by determining the resistance value of the eighth or the ninth printing element. If this value is infinite, a pin printing head of the 7-segment type is indicated.

In conjunction with a control unit, which contains the various control parameters of the types of printer heads planned for a printer, it is possible to make ready for a given printing head the control parameters dependent upon the type signal. By virtue of such a modus operandi, the overall investment for control remains minimal, since various printing heads of different types can be regulated by a single control unit. In the interchange of printing heads, the otherwise necessary interchange of control units can be dispensed with, thus making the operation of the printer simpler and accordingly safer.

Another embodiment of the invention is characterized by the fact that a control unit can, dependent upon the type of the printing head to be addressed, produce various control parameters, and that the control parameters matched to a given printing head can be adjusted by a type signal identifying the type of the printing head.

With this embodiment, the control unit receives via the type signal information relative to the type of the printing head present in a printer. Inasmuch as the control parameters of the various types of printing heads are known, is is possible to construct a control unit in such a way that it contains all of the control parameters of the types of printing heads provided in a printer, which parameters can then be called up on demand. The control parameters can be, e.g., stored as data in a memory or preestablished as switchable circuits. Then the set of control parameters for a certain type of printing head can be produced based on the type signal, so that the printer head is supplied with utilizable control information. By virtue of this modus operandi, the total investment for control remains minimal, since various types of printing heads can be regulated by a single control unit. In the interchange of printing heads, the interchange of control units, otherwise necessary under the heretofore prevailing state of the art, can be dispensed with, thus making the operation of the printer simpler and safer. In a printer with several printing stations, it is also possible to regulate several printing heads simultaneously. The various printing heads are then provided, e.g., in a multiplex timing procedure, with control parameters dependent upon the type signal identifying the type of the individual printing head to be addressed.

A circuit for carrying out the process of the invention is characterized by the fact that, for determining the resistance, a measuring resistor is provided, which is charged with a current dictated by the resistance value of a printing element. This resistor is in a series circuit with the resistor of the servo component of the printing element, for which the resistance value is to be determined. Both resistors, which are charged with the same current, thus form a voltage divider The voltage drop (U) at the measuring resistor is utilized as the measure of the resistance value of the printing element and is passed to a post-positioned evaluation circuit. This drop in voltage (U) is then converted to $U=V \cdot RM/(R+RM)$, wherein $V$=the feed voltage, $R$=the resistance of the printing element, and $RM$=the measured resistance.

In another embodiment of the invention, at least two printing elements are in parallel circuit via a decoupling diode operated in each case in the direction of passage. This parallel circuit is in a series circuit with the measuring resistor. This measure makes it possible to switch several printing elements of one or more printing heads without a rebound effect, i.e., in each case the blocking effect of a decoupling diode intervenes between the mutually connected printing elements, which prevents a current flow between such printing elements.

The decoupling diodes are connected in the circuit so that the testing charge required for determining the resistance value of the printing element can flow through in the passage direction of the decoupling diodes. The testing charges of the given printing elements are superimposed and flow through the measuring resistor to create a current. Connecting together several printing elements in the circuit in this manner results in a higher response sensitivity in the evaluation of the current.

In another refinement of the invention, a printing station, which can accommodate printing heads with a variable number of printing elements has at least one printing element belonging to a printing head with a lower number of printing elements and at least one printing element belonging to a printing head with a higher number of printing elements connected in a circuit with a given decoupling diode. IN a printing station, which can accommodate, e.g., both a pin printing head with 7 pins and a pin printing head with 9 pins, the printing elements number 6 and number 8, for example, are connected in circuit together via the decoupling diodes. When the printing station is occupied by the 9-pin printing head, the testing currents are added together in the measuring resistor. When, on the other hand, a 7-pin printing head is present in the printing station, the position of the ninth printing element is vacant and only the testing charge of the sixth printing element is evaluated. This makes it readily possible even to distinguish between printing heads with differing numbers of identical printing elements.

Another embodiment of the invention provides that the emitter-collector segment of a switching transistor, which is base-controlled by a testing signal, is interposed in the signal path between the measuring resistor and the printing element. The switching transistor is thus alternatingly set by the testing signal to the states of "block" and "conduct." In the "conduct" setting, the testing current for determining the resistance value [of the printing element] flows via the resistor of the printing element. In this state, the printing elements are at rest, i.e., the printing elements are not supplied with the current impulses, which trigger a printing operation and could "confuse" the testing current. In the "block" state, no testing current flows through the printing elements. The printing elements are then ready to receive the current impulses necessary for printing.

A further refinement of the circuit of the invention is characterized by the fact that, for production of the type signal, an evaluation circuit is provided, which includes at least one threshold-value circuit, the threshold value of which is related to a specific resistance range representing a type of printing head. The threshold-value circuit compares the current representing the resistance of a printing element with a reference value. This provides the threshold value, which, when exceeded triggers the output signal of the threshold-value circuit. The reference value is so selected that the two states of the output signal of the threshold-value circuit can be clearly assigned to a resistance range and thus to a certain type of printing head. Therefore, by means of this output signal, a maximum of two types of printing heads can be differentiated.

For the identification of a greater number of types of printing heads, a comparably greater number of threshold-value circuits are used. To this end, the output signals of the threshold-value circuits can be logically combined in an advantageous manner. This can be accomplished by conjunctively combining the output signal of each threshold-value circuit with the inverted output signals of the threshold-value circuits with a higher threshold value to form a type signal, and by emitting directly or via an inversion gate, as a type signal, the output signal of the threshold-value circuit with the highest threshold value. This measure ensures that every type of printing head is assigned a type signal. The logical combination of the output signals of the threshold-value circuits ensures that only one of the type signals bears the binary value of 1, while all other type signals bear the binary value of 0. Thus the signaling of a certain type of a printing head with digital coding is achieved in an especially simple fashion.

BRIEF DESCRIPTION OF THE DRAWINGS

Exemplary embodiments of the invention are described below with reference to the appended drawings wherein.

DETAILED DESCRIPTION OF THE PREFERRED EMBODIMENTS

Figure 1:
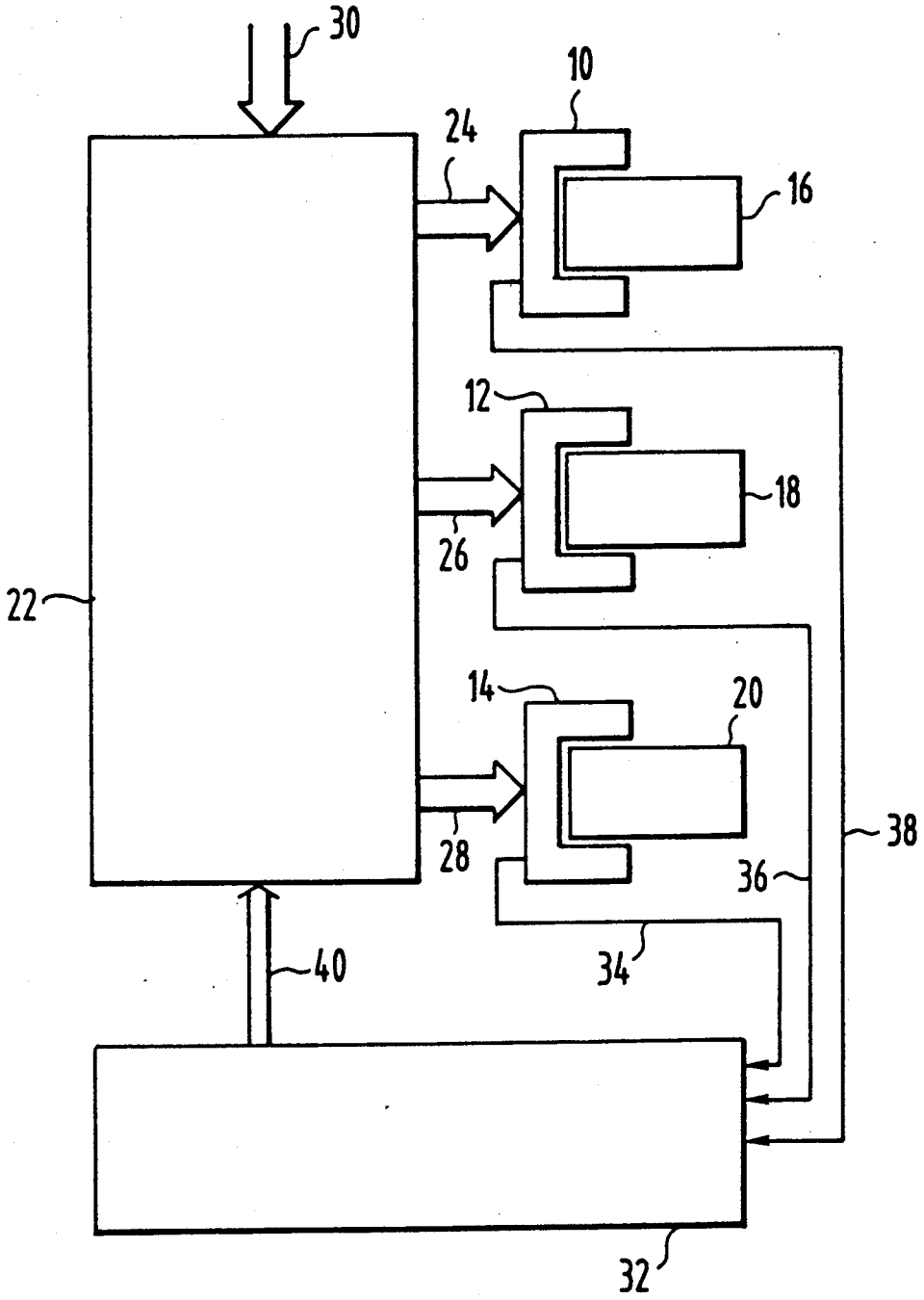
FIG. 1 is a block diagram depicting various functional units of a printer.

Depicted in FIG. 1 are various functional units of a printer containing several identified printing stations (10, 12, 14). Each of these printing stations (10, 12, 14) can accommodate a printing head, which is mechanically and electrically connected to the given printing station so as to be removable and interchangeable. The printing stations (10, 12, 14) are so designed that they can receive various types of printing heads. By way of example, printing station (10) in FIG. 1 is occupied by a printing head (16) designed as an ink-mosaic printer. In place at printing station (12) is a printing head (18), which functions in keeping with the pin printing process and has nine printing elements. Printing station (14) holds a pin printing head (20) with seven printing elements.

The printing heads (16, 18, 20) are supplied, via signal relays (24, 26, 28), with printing head-specific control parameters by a control unit (22). The control unit (22) receives, via a signal relay (30), the information to be printed from the main printer control (not depicted) or from an external control.

A circuit arrangement for printing head recognition (32) receives electrical signals (34, 36, 38) from the printing stations (10, 12, 14), which signals clearly characterize the type of the printing heads (16, 18, 20) present in the printing stations (10, 12, 14).

The circuit arrangement for printing-head recognition (32) forms from the electrical signals (34,, 36, 38) a type signal (40) identifying the type of the printing head, which signal is relayed to the control unit (22). The control unit (22) is then prepared to provide the various types of printing heads (16, 18, 20) with their respective printing head-typical control parameters.

Figure 2:
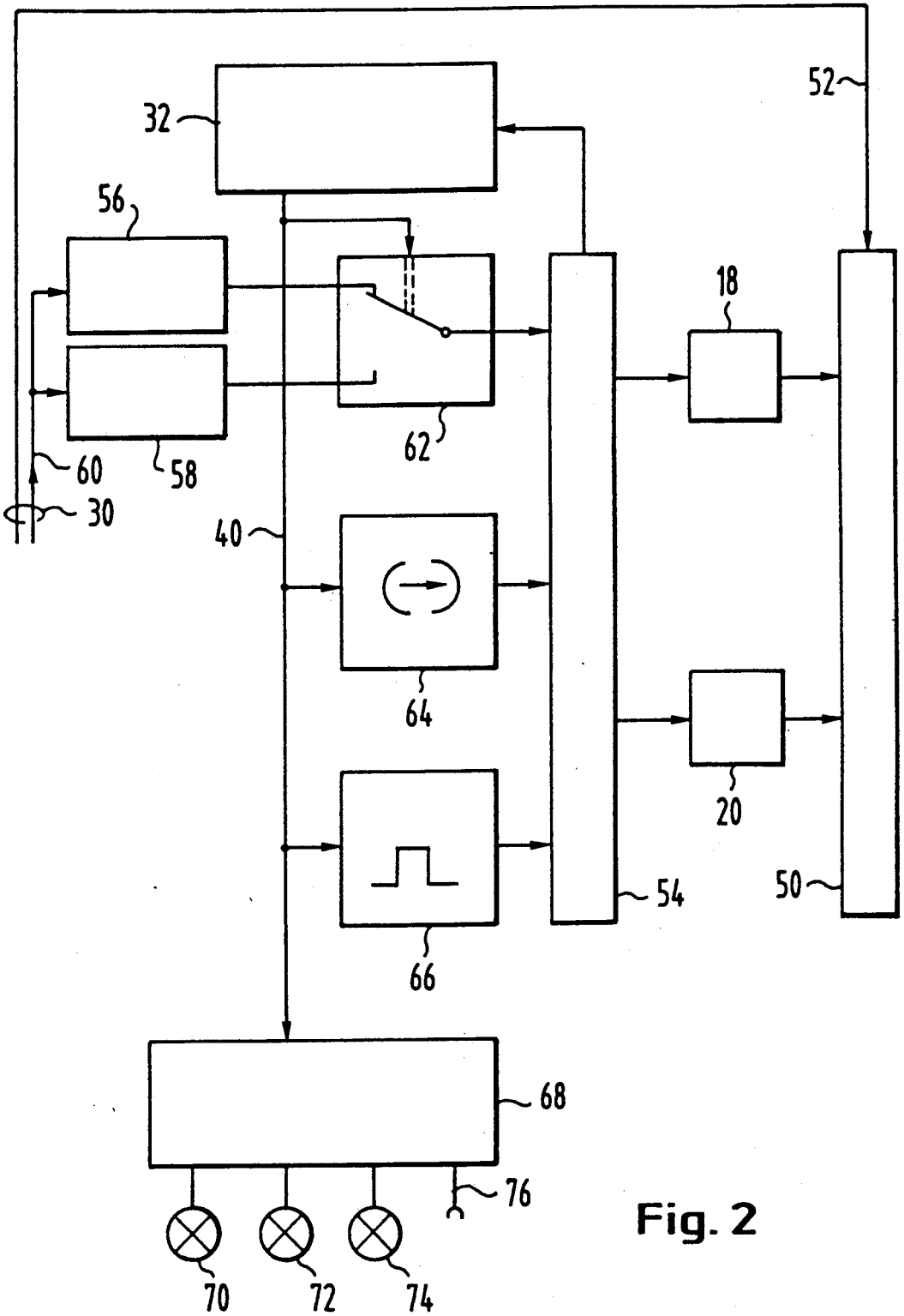
FIG. 2 is a block diagram showing component groups of a control unit for regulating printing heads.

Shown in FIG. 2, along with various other component groups, are the details of the control unit (22). The identifying numbers used in FIG. 1 for component groups described in connection therewith with are also used in FIG. 2. Via the circuit layout for printing head recognition (32), the type signal (40) is made available to various component groups. The different types of printing heads (16, 18, 20) are addressed via a multiplexer (50). In response to a multiplexer signal (52), the multiplexer switches one of the printing heads (16, 18, 20) to operational readiness. The multiplexer signal (52) is also produced by a superior control, which coordinates the printing action of various printing stations. A drive component (54) provides the current impulses necessary to actuate the individual printing elements of the printing heads (16, 18, 20). To this end, the drive component (54) is provided with printer head-specific control parameters to be described further below. The selection of the printing elements for the printing of a symbol or a mosaic dot ensues immediately via symbol generators (56, 58). Stored in the latter as symbol sets are the addresses of the printing elements in the printing head to be actuated to produce a certain printed symbol. The symbol generator (56) serves to produce printed symbols for a mosaic printing head with 9 printing elements and the symbol generator (58) for such a printing head with 7 printing elements. The information to be printed is supplied to the symbol generators (56, 58) by means of a signal (60) from the main control A data multiplexer (62) relays the data of one of the symbol generators (56, 58) to the drive component (54). Thus, the switching state of the data multiplexer (62) is controlled by the type signal (40).

The energy for actuating the printing elements selected by the symbol generator is drawn from a controllable power source (64). It provides at its output a defined charge, the strength of which is also controlled by the type signal (40).

Triggering of the printing action, as well as its duration, is regulated by a controllable timing component (66). It controls the on/off switching of the introduced current to the printing elements via the drive component (54). Both the duration of the current flow and the timing of the current impulses in relation to a position-reporting signal, which indicates the relative position between the printing head and the recording carrier, can vary for differing types of printing heads. For this reason, these timing parameters are produced in dependence upon the type signal (40) and relayed to the drive component (54).

Additionally, the type signal (40) is relayed to a display unit (68). The latter indicates via signal lights (70, 72, 74) the type of the printer heads (18, 20) present in a printer. By way of an adapter (76), the type signal (40) can also be emitted to be further evaluated at a different location. It is therefore also possible, by means of the type signal (40), to monitor and regulate the feed of the print carrier or the advance of the inked ribbon. Furthermore, other control elements, which regulate, e.g., the relative displacement between the printing head and the print carrier in both line and column directions, can also evaluate the type signal (40) in order to match control operations to the type of the printing head present in the printer.

Figure 3:
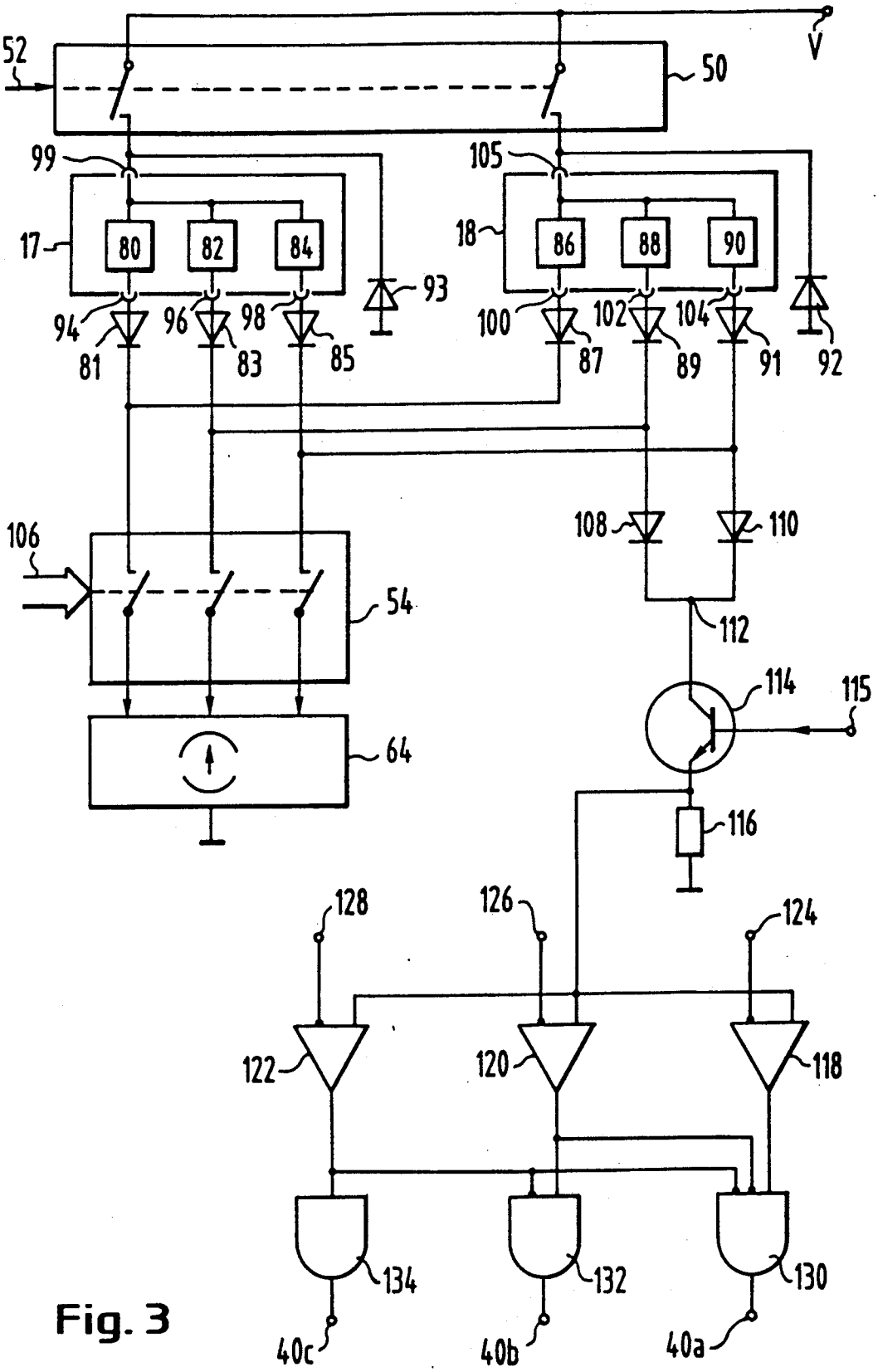
FIG. 3 is a schematic diagram of a circuit identification of various types of printing heads; and, FIG. 4 is a timing diagram showing signal paths and states of the circuitry layout in FIG. 3.

Illustrated in FIG. 3 is a circuit diagram permitting automatic recognition of various types of printing heads. The identifying numbers used in FIGS. 1 and 2, to the extend they are used for identical component groups, have been retained in FIG. 3. Via the multiplexer (50), a printing head (17), which functions in keeping with the thermal printing process, in addition to the pin printing head (18), is connected to the feed current (V). The multiplexer (50) is controlled by the multiplexer signal (52). For the printing heads (17, 18), three printing elements from among the multiple printing elements are depicted in each case. In the case of printing head (17), these are the printing elements (80, 82, 84), each of which is preceded by a diode (81, 83, 85), which prevents a flow of current between printing connected in parallel circuit with each other; in the case of printing head (18), the printing elements (86, 88, 90) are depicted, which are similarly preceded by the diodes (87, 89, 91). A diode (92) connected in the blocking direction serves to reduce current impulses, which can be generated as a result of induction occurring when the printing elements (86, 88, 90) are switched off. Another diode (93) connected in the blocking direction is also assigned to the printing head (17). This diode is, however, not absolutely necessary in the case of a thermal printing head, since the printing elements thereof have inherent ohmic characteristics. Nevertheless, since the thermal printing head (17) can be replaced by a pin printing head, the printing elements of which evidence inductive characteristics, the diode (93) is also provided here.

In order to be able to electrically disconnect the printing heads (17, 18) from the printer housing, terminal clips (94, 96, 98, 99; 100, 102, 104, 105) are provided. The printing elements (86, 88, 90) of the pin printing head (18) contain tiny electromagnets, which, upon receiving a current impulse, cause a movable pin to swing outward, which pin then produces a grid dot on a print carrier via an inked ribbon.

The pins of the printing elements (86, 88, 90) are arranged vertically one over the other, so that, when the printing elements (86, 88, 90) are actuated, movement of the printing head (18) across the print carrier produces gridded symbols on the latter. In conjunction with the controllable power source (64), the drive component (54) supplies the necessary current impulses. The selection of the printing elements (80, 82, 84), the time-related positioning, and the duration of the current impulses are effected by the control unit (22) as additional control parameters (106). In the case of the printing head (17), the printing elements consist of small electrical heating resistors, which heat up when a current is introduced and transfer dot-like printed symbols to the print carrier via a liquescent colored ribbon. In this case as well, the printing head (17) is supplied with current impulses from the drive component (54) and the controllable power source (64).

In each case, coupled in circuit with the joined cathodes of the diodes (83, 89), as well as with the cathodes of the diodes (85, 91), is the anode connection of a decoupling diode (108, 110), the cathode connections of which are brought together at a current addition point (112). The current addition point (112) is connected with the collector terminal of a switching transistor (114) of non-conductivity type, to the base of which a testing signal (115) is relayed. The emitter terminal of the switching transistor (114) is connected via a measuring resistor (116) with the reference potential and directly with the noninverting inputs of a first threshold-value circuit (118), a second threshold-value circuit (120), and a third threshold-value circuit (122). Introduced at the inverting inputs of the threshold-value circuits (118, 120, 122) are a first reference charge (124), a second reference charge (126) and a third reference charge (128). The reference charge (124) has the lowest value and the reference charge (128) has the highest. The threshold-value circuits (118, 120, 122) then carry at their output a low level signal whenever their respective reference charge (124, 126, 128) is greater than the charge at their noninverting inputs. When the charge exceeds the level of one of the reference charges (118, 120, 122), then the associated threshold-value circuit switches its output signal to high-level. The low-level represents the binary value of 0 and the high-level the binary value of 1.

The output signal of the threshold-value circuit (118) is relayed to an AND gate (130) at its noninverting input. It has two additional, albeit inverting inputs, to which the output signal of the threshold-value circuit (120) or that of the threshold-value circuit (122) is relayed. The output signal of the threshold-value circuit (120) is relayed to a second AND gate (132) at its noninverting input. An additional inverting input is connected with the output of the threshold-value circuit (122). Finally, a third gate (134) is provided in the circuit layout, which functions as a noninverting drive circuit and whose input is directly connected with the output of the threshold-value circuit (122). The gates (130, 132, 134) produce the type signals (40*a*, 40*b*, 40*c*).

The method of operation of the circuitry layout for printing head recognition is described below. First, let it be assumed that the multiplexer (50) is so regulated via the multiplexer signal (52) that the printing head (17) is connected to the feed current (V). The printing head (17) is then activated and a testing phase can be initiated, in which the type of the printing head will be determined. To this end, the switching transistor (114) is base-activated by the testing signal (115) so as to be in a conductive state. At the same time, the drive component (54) is so triggered that the switches indicated in FIG. 3, which supply the printing elements (80, 82, 84) with current, are opened. The signals for regulating the switching transistor (114) and the drive components are supplied by an main control (not shown).

Via the current path formed by the printing element (82), the diode (83), and the diode (108), the current flows to the current collection point (112), where it is added to the current flowing via the printing element (84), the diode (85), and the diode (110) and grounded via the switching transistor (114) and the measuring resistor (116). The strength of the charge is essentially determined by the strength of the feed current (V), the level of the resistance of the printing elements (82, 84), and the measuring resistor (116). At the measuring resistor (116), this current loses a charge, which is relayed to the threshold-value circuits (118, 120, 122). The threshold-value circuits (118, 120, 122) compare this charge with the reference charges (124, 126, 128) relayed to them and switch their output signal to high-level when the charge at the measuring resistor (116) is greater than a given reference charge (124, 126, 128).

The resistance of the printing elements (82, 84) is known and varies only within a very restricted range. Consequently, the currents passing through the measuring resistor (116), as well as their drop in strength, is characteristic for the type of the tested printing head (16). The reference charges (124, 126, 128) are accordingly assigned to certain voltage ranges at the measuring transistor, which recognizes a definitive type of a printing head. They are selected so that they always lie at the lower limit of such a voltage range.

Let it be assumed that the actual charge at the measuring transistor (116) is slightly greater than the reference charge (126), so that the output of the threshold-value circuit (120) is set at its high-level representing the binary value of 1. Since, as already noted, the reference charge (124) is lower than the reference charge (126), the output signal of the threshold-value circuit (118) also has the binary value of 1. However, the output signal of the threshold-value circuit (120) is relayed to the post-positioned AND gate (130) in inverted form, so that the logical result of the AND connection is 0 and a type signal (40*a*) with the binary value of 0 is output from the AND gate (130). Let it be further assumed that the reference charge (128) is greater than the charge at the measuring transistor (116). Then the logical output signal of the threshold-value circuit (122) is 0, as is the type signal (40*c*) of the gate (134). The output signal of the threshold-value circuit (122) is relayed to the AND gate (132) in inverted form, so that, together with the binary value of 1 of the threshold-value circuit (120), the AND condition of 1 of the threshold-value circuit (120), the AND condition is fulfilled and the type signal (40*b*) with the binary value of 1 is produced at the AND gate (132). In this case, the type signal (40*b*) is assigned to the "thermal printing head" type of printing head. The binary value of 1 indicates that the tested printing head (17) is a thermal printing head. Due to the special logical combination of the output signals of the threshold-value circuits (118, 120, 122), assurance is given that only one of the type signals (40*a*, 40*b*, 40*c*) can have the binary value of 1. By virtue of this kind of type-signal generation, the type of a printing head can be displayed in the form of a simple and definitive code. However, other forms of coding are also conceivable, e.g., serial coding by conversion of the charge at the measuring transistor (116) into a frequency, or a PCM coding, etc. The binary information must then be decoded in a known manner by the control unit (22) and can then be subsequently evaluated. It is also conceivable that the output signals of the threshold-value circuits (118, 120, 122) be couched as bits of a binary word. In this case, the gates (130, 132, 134) could be dispensed with. When the charge at the measuring transistor (116) exceeds the first reference charge (124), the binary word then has the value of 1; when said charge exceeds the reference charge (126), the binary word has the value of 3; and when the reference charge (128) is exceeded, the value of the binary word is 7.

The testing phase is terminated by returning the switching transistor (114) to the blocked state by means of the testing signal (115). The printing elements (80, 82, 84) of the printing head (17) can then be actuated by current impulses from the drive component (54) and proceed to execute the printing action. Upon completion of the printing action, the printing head (17) is disconnected from the feed current (v). At this point, the printing head (18) can be switched into operational readiness by the multiplexer (50). In this case as well, the type of the printing head is determined as described above in a testing phase preceding the start of the printing.

The head recognition outlay with the components (124–124) can be analogously expanded depending upon the number of printing heads to be identified. It is also possible to identify printing heads with identical resistance of the printing elements but with a different number of printing elements. Present by way of example here are a 7-pin printing head and a 9-pin printing head. For purposes of identification, the anode of the diode (108) is coupled in a circuit with a printing element present in both printing heads, e.g., printing element number 7. The anode of the diode (110) is coupled in a circuit with the printing element, which is present only in the printing head with the greater number of pins, e.g., printing element number 8. When the printing station is occupied by a 9-pin printing head, the combined current of the parallel coupled printing elements 7 and 8 flows in the measuring transistor (116). If, however, a 7-pin printing head is present in the printing station, the testing current evaluated for printing head recognition is reduced by one half.

Furthermore, it is possible to load a threshold-value circuit with a reference charge of 0 volts. This then makes it possible to recognize and signal the absence or the defectiveness of a printing head or a printing element.

Figure 4:
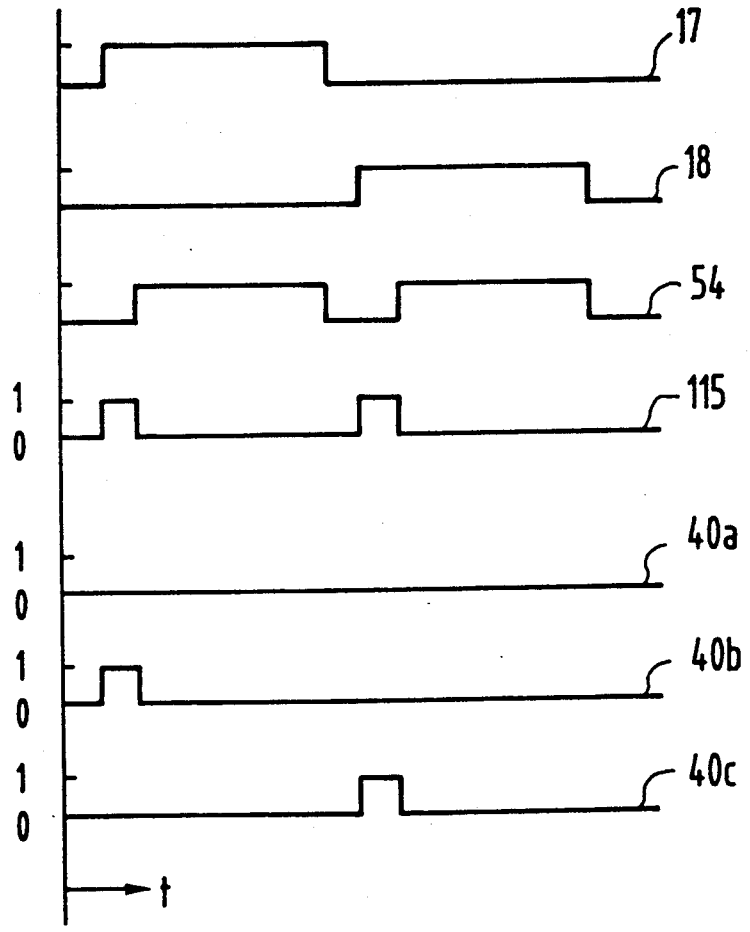

Depicted in FIG. 4 are the various signals and states of the circuit shown in FIG. 3 over the course of a time (t). Introduction of the feed current (V) via the multiplexer component (50) switches printing head (17) or printing head (18) from the inactive state to one of operational readiness, which is indicated in FIG. 4 as the states of "OFF" and "ON." Following the engagement of the printing head (17), identification of the printing head type ensues. To this end, the testing signal (115) is set to the binary value of 1 for a preestablished period of time. During this time, the drive component (54) remains disengaged, i.e., the printing elements of the printing head (17) are not supplied with current impulses.

During the testing phase, the resistance of the printing element (82, 84) of the printing head (17) is determined and the type signal (40*b*) assumes the binary value of 1 for the duration of the testing. The testing procedure is terminated by resetting the testing signal (115) to the binary value of 0, whereupon the type signal (40*b*) also assumes the binary value of 0. The actual printing action can then follow, which is controlled by the drive component (54).

In an identical fashion, the type of the printing head (18) can be determined, to which end the aforesaid steps are followed. The type of printing head (18) is indicated in this case by the binary value of 1 for the type signal (40*c*), which is the type signal for pin printing heads.

The process of the invention can be utilized for essentially all types of printing heads. The only prerequisite is that the servo components of the printing elements have a measurable electrical resistance. This must not necessarily consist of an active resistance, but rather can also be a reactive impedance, e.g., a capacitive resistance in the case of a piezo servo component for an ink-spray printing head, or a passive impedance with mixed capacitance and inductance.

In the case of reactive or passive impedance, it is practical for determining the resistance of the servo component of the printing elements that the same be included as part of a circuit, to which a testing signal in the form of a current or a charge with a preestablished time-related course is introduced. The frequency dependency of the reactive components of the resistance causes a characteristic change of the testing signal, which can be determined from such electrical values as voltage, flow rate, and phase in the circuit. These values are then evaluated in keeping with known procedures of network analysis and the results are used in determining the electrical resistance of the servo component.

Preferably, a certain curve form, e.g., a rectangular form, is imparted to the testing signal. The distortion of the curve caused by the reactive components of the resistance, which can be measured, e.g., as charges at a measuring resistor in the circuit, is then a measure for the resistance value. In a simple fashion, it is also possible to determine whether the servo component contains an inductive or a capacitive resistance component. A piezo servo component of an ink-spray printing head has a capacitive resistance. The effect thereof is that, when a rectangular testing signal charge is introduced into the circuit, a higher charge is immediately induced therein, which then drops off exponentially in further operation. When the servo component has an inductive component, which is the case with a pin printing head, the charge in the circuit intensifies only slowly. By evaluating the course of the current against time it is also possible to determine the type of the servo component and thus also the type of the printing head.

The rectangular form of the testing signal is only one of several possible curve forms. Other known forms are, e.g., sawtooth curves, impulse ramps, or pin impulses. These curve forms are also characteristically distorted when the resistance of the servo component has a reactive portion, so that the latter can be utilized in conjunction with the active portion in determining the type of the printing head. Furthermore, it is also possible to use an alternating signal as the testing signal, e.g., a sinusoid alternating current, the frequency of which is adjustable. It is then possible to match the value of the reactive component of the resistance of the servo component to a preestablished evaluation range and further increase the sensitivity of a post-circuited evaluation element for recognition of printing heads with frequency-dependent resistance components.

What is claimed is:

1. A method for identifying the type of print head present in a printer employing any of a plurality of types of print heads and wherein each print head includes at least one print element having a characteristic electrical resistance, comprising the steps of:

(A) associating said print heads respectively with a plurality of resistance values, such that each of said print heads is uniquely associated with one of said resistance values;

(B) sensing the resistance value of said at least one print element; and, (C) producing a type signal identifying the type of print head present in said printer based on the value of the resistance sensed in step (B).

2. The method of claim 1, wherein at least certain of said print heads include a plurality of said print elements, and step (B) is performed by sensing the resistance of only a portion of said plurality of print elements.

3. The method of claim 1, including the steps of:

(D) associating said plurality of print heads respectively with a plurality of sets of control parameters; and, (E) selecting one of the sets of control parameters in said plurality of sets thereof based on the type signal produced in step (C).

4. The method of claim 2, including the steps of:

(D) associating said plurality of print heads respectively with a plurality of sets of control parameters; and, (E) selecting one of the sets of control parameters in said plurality of sets thereof based on the type signal produced instep (C).

5. The method of claim 1, wherein the print elements of at least certain of said print heads define differing sets of symbols, and step (B) is performed by sensing the electrical resistance of the print elements defining said symbols.

6. The method of claim 3, wherein the print elements of at least certain of said print heads define differing sets of symbols, and step (B) is performed by sensing the electrical resistance of the print elements defining said symbols.

7. The method of claim 1, including the step of controlling one of (1) the feed of a print carrier, (2) the advance of an inked print ribbon, or (3) the relative displacement between the printing head and a print carrier, based on the type signal produced in step (C).

8. The method of claim 2, including the step of controlling one of (1) the feed of a print carrier, (2) the advance of an inked print ribbon, or (3) the relative displacement between the printing head and a print carrier, based on the type signal produced in step (C).

9. The method of claim 3, including the step of controlling one of (1) the feed of a print carrier, (2) the advance of an inked print ribbon, or (3) the relative displacement between the printing head and a print carrier, based on the type signal produced in step (C).

10. The method of claim 5, including the step of controlling one of (1) the feed of a print carrier, (2) the advance of an inked print ribbon, or (3) the relative displacement between the printing had and print carrier, based on the type signal produced in step (C).

11. The method of claim 1, wherein step (B) is performed by:

applying a testing signal to an electrical evaluation circuit for evaluating the resistance of said at least one print head, and evaluating at least one electrical value in said evaluation circuit upon the application of said testing signal to said testing circuit.

12. The method of claim 11, wherein aid evaluation circuit includes a resistor and said electrical value is the voltage across said resistor.

13. The method of claim 11, wherein said testing signal possesses a preselected waveform, and step (B) is performed by evaluating distortion in said waveform.

14. The method of claim 13, wherein said waveform is rectangular and the evaluating step is carried out by evaluating one of the rising or falling flanks of the rectangular waveforms.

15. The method of claim 11, wherein said testing signal possesses a variable value, and said method further includes the step of selecting the frequency of said testing signal so that the reactive component of electrical value exceeds a pre-established value.

16. Apparatus for identifying the type of print head present in a printer employing any of a plurality of types of print heads and wherein each print head includes at least one print element having a characteristic electrical resistance, comprising:

means for applying electrical power to said one print element and resulting in the flow of an electrical current through said one print element;

measuring means for measuring the electrical resistance of said print element based on the electrical current flow through said one print element; and means responsive to said measuring means for producing a type signal representing the type of print head present in said printer, said type signal producing means including at least one threshold-value circuit possessing a threshold value associated with a range of resistive values representing a certain type of print head.

17. Apparatus for identifying the type of print head present in a printer employing any of a plurality of types of print heads and wherein each print head includes at least one print element having a characteristic electrical resistance, comprising:

means for applying electrical power to said one print element and resulting in the flow of an electrical current through said one print element;

measuring means for measuring the electrical resistance of said print element based on the electrical current flow through said one print element wherein said measuring means includes a measuring resistor and a voltage is applied to said resistor which is a function of the value of said electrical current flow through said one print element; and means responsive to said measuring means for producing a type signal representing the type of print head present in said printer, said type signal producing means including at least one threshold-value circuit possessing a threshold value associated with a range of resistive values representing a certain type of print head.

18. Apparatus for identifying the type of print head present in a printer employing any of a plurality of types of print heads and wherein each print head includes at least one print element having a characteristic electrical resistance, comprising:

means for applying electrical power to said one print element and resulting in the flow of an electrical current through said one print element;

measuring means for measuring the electrical resistance of said print element based on the electrical current flow through said one print element wherein said measuring means includes a measuring resistor and a voltage is applied to said resistor which is a function of the value of said electrical current flow through said one print element and wherein said measuring means also includes a pair of decoupling diodes and at least two of said printing elements are respectively coupled in series with said diodes and said measuring resistor; and means responsive to said measuring means for producing a type signal representing the type of print head present in said printer, said type signal producing means including at least one threshold-value circuit possessing a threshold value associated with a range of resistive values representing a certain type of print head.

19. Apparatus for identifying the type of print head present in a printer employing any of a plurality of types of print heads and wherein each print head includes at least one print element having a characteristic electrical resistance, comprising:

means for applying electrical power to said one print element and resulting in the flow of an electrical current through said one print element;

measuring means for measuring the electrical resistance of said print element based on the electrical current flow through said one print element, wherein said measuring means includes a measuring resistor and a voltage is applied to said resistor which is a function of the value of said electrical current flow through said one print element and wherein said measuring means also includes a pair of decoupling diodes and at least tow of said printing elements are respectively coupled in series with said diodes and said measuring resistor and wherein said two printing element respectively form a part of a first printing head having a given number of print elements and a second printing head having a number of printing elements less than said given number; and means responsive to said measuring means for producing a type signal representing the type of print head present in said printer, said type signal producing means including at least one threshold-value circuit possessing a threshold value associated with a range of resistive values representing a certain type of print head.

20. The apparatus of claim 16, wherein said type signal producing means includes a plurality of said threshold-value circuits each generating an output signal, and means for conjunctively joining said output signals in a manner such that only the output signal of the threshold-value circuit having the highest threshold value is used to provide said type signal.

* * * * *

UNITED STATES PATENT AND TRADEMARK OFFICE

CERTIFICATE OF CORRECTION

PATENT NO. : 5,033,887

DATED : July 23, 1991

INVENTOR(S) : Ralph Bäuerle

It is certified that error appears in the above-identified patent and that said Letters Patent is hereby corrected as shown below:

ON THE TITLE PAGE

In the Abstract, line 12, change "whic" to --which--.

Column 13, line 14, change "had" to --head--.

Signed and Sealed this

Eighth Day of June, 1993

Michael K. Kirk

*Attest:*

MICHAEL K. KIRK

*Attesting Officer*

*Acting Commissioner of Patents and Trademarks*